US007156486B2

(12) United States Patent
Eguchi et al.

(10) Patent No.: US 7,156,486 B2
(45) Date of Patent: Jan. 2, 2007

(54) LIQUID EJECTION HEAD, LIQUID EJECTION APPARATUS, AND MANUFACTURING METHOD OF THE LIQUID EJECTION HEAD

(75) Inventors: Takeo Eguchi, Kanagawa (JP); Atsushi Nakamura, Kanagawa (JP); Akihito Miyazaki, Kanagawa (JP); Shigeyoshi Hirashima, Kanagawa (JP); Naoshi Ando, Kanagawa (JP)

(73) Assignee: Sony Corporation, Tokyo (JP)

( * ) Notice: Subject to any disclaimer, the term of this patent is extended or adjusted under 35 U.S.C. 154(b) by 150 days.

(21) Appl. No.: 11/062,419

(22) Filed: Feb. 22, 2005

(65) Prior Publication Data

US 2005/0195238 A1 Sep. 8, 2005

(30) Foreign Application Priority Data

Feb. 23, 2004 (JP) ..... P2004-045720
Apr. 5, 2004 (JP) ..... P2004-110866

(51) Int. Cl.

| | |
|---|---|
| ***B41J 2/155*** | (2006.01) |
| ***B41J 2/15*** | (2006.01) |
| ***B41J 2/145*** | (2006.01) |
| ***B41J 2/21*** | (2006.01) |
| ***B41J 29/38*** | (2006.01) |

(52) U.S. Cl. ..... 347/42; 347/40; 347/43; 347/17

(58) Field of Classification Search ..... 347/40, 347/42, 49, 43, 17

See application file for complete search history.

(56) References Cited

U.S. PATENT DOCUMENTS

| | | | | |
|---|---|---|---|---|
| 5,971,522 | A * | 10/1999 | Ono et al. | 347/40 |
| 2002/0067395 | A1 * | 6/2002 | Horii et al. | 347/47 |
| 2003/0156156 | A1 * | 8/2003 | Sakaida et al. | 347/47 |

* cited by examiner

*Primary Examiner*—Lamson Nguyen
*Assistant Examiner*—Lisa M. Solomon
(74) *Attorney, Agent, or Firm*—Sonnenschein Nath & Rosenthal LLP

(57) ABSTRACT

A line head includes a nozzle plate, a frame-shaped outer frame, a plurality of head chips, and a head support member arranged within the outer frame. The linear expansion coefficients of the nozzle plate and the head support member are larger than that of the outer frame. The nozzle plate is joined onto the outer frame and a tensile stress is produced in the nozzle plate by the outer frame. The head support member is joined and fitted with the outer frame. When the head support member thermally expands relative to the outer frame, a compression stress is produced in the head support member while a strain of the head support member is restricted by the outer frame.

23 Claims, 10 Drawing Sheets

SIDE VIEW OF HEAD SUPPORT MEMBER 14A

TOP PLAN VIEW OF STRAIN ABSORPTION PLATE 14c

TOP PLAN VIEW

SIDE VIEW

BOTTOM VIEW
(NOT INCLUDING NOZZLE PLATE 3)

BOTTOM VIEW
(INCLUDING NOZZLE PLATE 3)

END PORTION OF LINE HEAD 1

CENTRAL PORTION OF LINE HEAD 1

LIQUID EJECTION HEAD, LIQUID EJECTION APPARATUS, AND MANUFACTURING METHOD OF THE LIQUID EJECTION HEAD

RELATED APPLICATION DATA

The present application claims priority to Japanese Application(s) No(s). P2004-045720 filed Feb. 23, 2004, which application(s) is/are incorporated herein by reference to the extent permitted by law.

BACKGROUND OF THE INVENTION

1. Field of the Invention

The present invention relates to a liquid ejection head used for a thermal inkjet-printer head for ejecting liquid using thermal energy, a liquid ejection apparatus having the liquid ejection head, and a manufacturing method of the liquid ejection head. In detail, the invention relates to a technique in that the strain of liquid-ejection head components due to temperature variation is minimized so as to suppress characteristic degradation produced in the liquid ejection head.

2. Description of the Related Art

Among liquid ejection heads, in an inkjet-printer head employing a thermal system for an inkjet printer, a head chip is used having several hundreds of heater elements formed on a semiconductor substrate. While one head chip is used in the case of monochrome, in a color head, a two-block structure may be often adopted that is composed of a three-color head of Y (yellow), M (magenta), and C (cyan) integrally constructed at equal intervals and a K (black) head separately provided.

For increasing the printing speed, a number of liquid ejection parts (including nozzles, heater elements, and liquid chambers) may be provided within one head as many as possible, as one method. The liquid ejection part must have nozzles, heater elements, and liquid chambers as well as flow paths for communicating the entire liquid chambers together, so that the minimal area therefor is required.

Thus, at present, about 600 DPI (pitch of 42.3 μm) is assumed to be a limit. For example, a head having 256 liquid ejection parts at 600 DPI has a length of 10.8 mm. With increasing liquid ejection part size, the handling becomes difficult, reducing yield and increasing cost.

Accordingly, a thermal line head technique has been known in that a plurality of head chips are arranged so as to form one large line head as disclosed in Japanese Unexamined Patent Application Publication No. 2002-127427. By the structure mentioned above, a chip head having 320 heater elements at 600 DPI (15.4 mm length) is made, for example, so as to form a line head by arranging the 64 chip heads, which can record images over the width of an A-4 size sheet (Japanese Standard, 210 mm) at one time.

FIGS. 8A to 8D are schematic views of such a line head 1. In FIGS. 8A to 8D, electric connections to head chips 4A to 4D are eliminated. Proportions in thickness and length of components are different from facts in the drawing for description convenience sake. Also, the line head for the A-size has the 64 head chips as mentioned above; however, for simplification, the four head chips 4A to 4D will be described with reference to FIGS. 8A to 8D. Referring to FIGS. 8A to 8D, the line head 1 includes a nozzle plate 3, four head chips 4A to 4D and six dummy chips 5A to 5F, which are bonded on one surface of the nozzle plate 3, and a flow path plate 2 formed further over these chips.

FIG. 9 is a sectional view showing the flow path plate 2, the head chip 4, and the nozzle plate 3 in detail. As shown in FIG. 9, the head chip 4 has heater elements 4*b* arranged on a semiconductor substrate 4*a*. At 600 DPI, the 320 heater elements 4*b* are arranged for one head chip 4. On the surface having the heater elements 4*b* arranged thereon, a barrier layer 4*c* is laid so as to form the liquid chamber.

The nozzle plate 3 has an arrangement of nozzle openings 3*a* formed therein at positions corresponding to those of the heater elements 4*b* of the head chip 4.

In the example shown in FIGS. 8A to 8D, the head chips 4 are arranged in a staggered form. Between the head chips 4, the dummy chips 5 are arranged substantially without clearance (between the head chips 4A and 4C, the dummy chip 5C is arranged, for example). The dummy chip 5 is the same as the head chip 4 at least in height, and it may have the same shape as that of the head chip 4 and may not have the heater elements 4*b*. The dummy chip 5 does not eject ink.

Furthermore, the dummy chips 5A and 5F among the dummy chips 5A to 5F are arranged at both ends of the head chips 4A to 4D in the longitudinal direction, so that a liquid supply path 2*a* is surrounded with the head chips 4A to 4D and the dummy chips 5A to 5F. Also, the head chips 4A to 4D and the dummy chips 5A to 5F form a flat surface on which the flow path plate 2 is bonded.

The flow path plate 2 includes a liquid inlet 2*b* formed at the upper center and the liquid supply path 2*a* formed inside the flow path plate 2 so as to communicate the liquid inlet 2*b* and the head chips 4.

Referring to FIG. 9, when the heater element 4*b* arranged on the head chip 4 is heated, bubbles are produced on the heater element 4*b*. Although the bubbles diminish within a short period of time, a soaring force is applied to liquid on the heater element 4*b* by pressure changes due to generation/extinction of the bubbles at this time. Then, by the soaring force, liquid droplets are ejected from the nozzle opening 3*a*.

The heat in the head chip 4 is almost generated from the heater element 4*b*. Furthermore, even on the side of the heater element 4*b*, with which liquid is not brought into contact, the heat produced from the heater element 4*b* is transferred because the heater element 4*b* comes contact with the semiconductor substrate 4*a*.

The heat produced in the head chip 4 is transferred to the liquid moving every ejection of liquid droplets. In other places, the bottom surface of the head chip 4, for example, the heat is transferred to the flow path plate 2 via an adhesion layer 6 between the head chip 4 and the flow path plate 2, and in the front surface of the head chip 4, the heat is transferred to the nozzle plate 3 via the barrier layer 4*c* of the head chip 4.

However, the conventional technique described above has the following problems in a practical application.

As the single head chip 4 is about 20 mm in size as mentioned above, even when the head chip 4 has the nozzle plate 3 with the nozzle opening 3*a* and the flow path plate 2 bonded thereon, if strain is generated by the thermal stress between components due to thermal expansion, the stain is not at the level to a failure in a serial system.

On the other hand, when a number of the head chips 4 are connected together like in the line head 1, as the length in the longitudinal direction is increased, the expansion difference due to thermal expansion, i.e., the difference between linear expansion coefficients becomes a problem depending on materials arranged on the front surface of the head chip 4 (the side of the nozzle plate 3) and on the bottom surface (the side of the flow path plate 2).

If materials of the flow path plate 2, the head chip 4, and the nozzle plate 3 have substantially the same linear expansion coefficient, the thermal expansion problem does not arise. However, upon selecting materials of the flow path plate 2, the head chip 4, and the nozzle plate 3, characteristics or functions required for each member are different, so that each member must satisfy the required characteristics or functions.

For example, for the flow path plate 2, cast aluminum is given at first. This is because of its excellent workability and thermal conductivity. Then, an injection-molded acrylic resin is given. This is because of its excellent wettability and workability as well as lower Young's modulus in comparison with aluminum.

Furthermore, for the barrier layer 4*c*, a high-polymeric material, typified by a photosensitive cyclized-rubber resist or an exposure-curing dry-film resist, is shown. This is because of its strong adhesive force, higher hardness after cured than that an acrylic resin, and low cost.

Also, as the nozzle plate 3, electrocasting nickel is given because the nozzle opening 3*a* is comparatively simply constructed by that, its thermal expansion is comparatively small, as well as its wettability and cost are within a practical application.

As described above, each member must select a material as well as a fabricating method so as to satisfy characteristics or functions required for each member. When materials of the flow path plate 2, the head chip 4, and the nozzle plate 3 are selected in such view, linear expansion coefficients thereof are to be different from each other.

FIGS. 10A to 10C are sectional views illustrating generation of thermal stress and strain in the line head 1, wherein FIG. 10A qualitatively shows the extent of displacement due to temperature changes. In the drawing, the center of the line head 1 in the longitudinal direction is established to be an original point. In this case, with increasing temperature, the nozzle plate 3 and the flow path plate 2 are elongated so that the closer to both ends from the center, the displacement becomes larger relative to the position before temperature rise, as shown in the drawing. The length of arrow indicates the magnitude of its displacement.

FIG. 10B is a sectional view showing an example of deformation due to temperature change. When linear expansion coefficients of the flow path plate 2 and the nozzle plate 3 are different from that of the head chip 4 (those are larger than that of the head chip 4, in this example), the flow path plate 2 and the nozzle plate 3 are to be elongated longer than the length of the line of the head chips 4, and are warped like an arrow in the drawing as a bimetal phenomenon if between the flow path plate 2, the head chip 4, and the nozzle plate 3 are bonded together with an adhesive while other parts are free.

When the line head 1 is warped like an arrow in such a manner, the distance between a recording medium and each head chip is changed. For example, in the head chips 4 located at both ends, the distance between the nozzle plate 3 and the recording medium is not so changed; however, the head chip 4 is inclined (not in parallel) to the recording medium. On the other hand, in the head chips 4 located in the central portion, with the line head 1 warped like an arrow, although the parallel is not so changed, the position of the head chip 4 is moved upward, so that the distance to the recording medium is elongated.

Then, in order to prevent the deformation like an arrow, the positional relationship between the line head 1 and a recording medium is maintained by applying a force to the line head 1.

As shown in FIG. 10C, the line head 1 is pressurized at the central portion from the top while being supported at both ends from the bottom by applying forces F1 to F3 thereto, so that the deformation like an arrow can be suppressed (evenness is maintained).

In this case, however, shear stresses are produced between the flow path plate 2 and the head chips 4 and between the head chips 4 and the nozzle plate 3, as shown by arrows in the drawing, and the closer to both the ends, magnitudes of the shear stresses are increased.

In particular, on the head chip 4, the barrier layer 4*c* is laid as mentioned above so as to form a liquid chamber and an individual flow path with the barrier layer 4*c*. The strength of these portions is smaller than that of the semiconductor substrate 4*a* of the head chip 4 or the nozzle plate 3 so as to cause elastic deformation and plastic deformation due to the shear stress, so that it may be difficult for the liquid chamber and the individual flow path to satisfy the required characteristics.

FIGS. 11A and 11B show pictured results of a liquid ejection part of the line head 1 when such thermal stress is applied thereto, wherein FIG. 11A shows the central portion of the line head 1.

As shown in FIG. 11A, deformation (strain) scarcely exists. Whereas, as shown in FIG. 11B, at both ends of the line head 1, the barrier layer 4*c* is deformed so as to possibly affect ejection characteristics.

For reducing such effect, in a general operating proof temperature range of a printer, such as a range between 15 to 35° C., changes in ejection characteristics need to be further reduced to temperature changes.

SUMMARY OF THE INVENTION

Accordingly, it is a problem to be solved by the present invention to suppress changes in ejection characteristics due to temperature changes when a line head is configured by arranging a plurality of head chips.

Thus, the present invention solves the problems described above by the following solving means:

A liquid ejection head according to the present invention includes a nozzle plate having nozzle holes formed thereon for ejecting liquid droplets; a frame-shaped first support base; a head chip having a plurality of heater elements arranged on a semiconductor substrate; and a second support base, at least part of which being arranged within a region inside the frame of the first support base, the liquid ejection head having a plurality of the head chips joined onto the nozzle plate in a line so that the heater elements oppose the nozzle holes, respectively, wherein the linear expansion coefficient of the head chip is substantially the same as that of the first support base; the linear expansion coefficient of the nozzle plate is larger than that of the first support base; and the linear expansion coefficient of the second support base is larger than that of the first support base, wherein the nozzle plate is joined onto the first support base while under the circumstance of temperature at which a thermal stress is not generated on the junction surface between the first support base and the second support base, a tensile stress is produced in the nozzle plate by the first support base, wherein the second support base is joined onto the first support base so that at least parts of external side faces at both ends of the second support base in a longitudinal direction are fitted between at least parts of internal side faces of the first support base, and wherein when the second support base thermally expands relative to the first support base, a compression stress is produced in the second support base while a strain of the second support base is restricted by the first support base.

According to the present invention, the nozzle plate is joined onto the first support base while the linear expansion coefficient of the nozzle plate is larger than that of the first support base. Thereby, when the nozzle plate is joined onto the first support base at high temperature, the nozzle plate expands/contracts corresponding to expansion/contraction of the first support base at normal temperature. Since the linear expansion coefficient of the head chip is substantially the same as that of the first support base, and the head chips are joined onto the nozzle plate, the head chip expands/contracts following the first support base.

Also, the second support base is joined onto the first support base so that the second support base is fitted with the first support base, and the linear expansion coefficient of the second support base is larger than that of the first support base. When the second support base thermally expands relative to the first support base, a strain of the second support base is restricted by the first support base.

BRIEF DESCRIPTION OF THE DRAWINGS

FIGS. 1A to 1C show a line head according to an embodiment, wherein FIG. 1A is an exploded plan view before assemble, FIG. 1B is a side view before assemble, and FIG. 1C is a side sectional view after assemble;

DESCRIPTION OF THE PREFERRED EMBODIMENTS

According to the present invention, when a line-system liquid ejection head is formed by connecting head chips, the strain due to the difference in thermal expansion coefficient between members can be minimized, so that printing quality is not affected by temperature change.

In addition, the liquid ejection head corresponds to a line head 10 according to following embodiments. A first support member corresponds to an outer frame 11; a second support member corresponds to a head support member 14 also serving as a flow path plate according to the embodiments.

An embodiment according to the present invention will be described below with reference to the drawings. In the following embodiments, an inkjet printer is exemplified as a liquid ejection apparatus; a thermal line head is exemplified as a liquid ejection head used in the liquid ejection apparatus.

The terms below in the specification and Claims mean as follows: "junction" means perpetual connection not assuming separation (or exfoliation) and including both (1) bonding components together with an adhesive and (2) junction (connection) by ultrasonic joining or welding by applying thermo-compression or ultrasonic vibration without using an adhesive (without interposing the adhesive between the components).

Furthermore, "bonding" is a kind of the junction and means to connect members together (bonding them together) with an adhesive (interposing the adhesive between the members) for perpetual connection not assuming separation (or exfoliation).

Figures 1A, 1B, 1C:
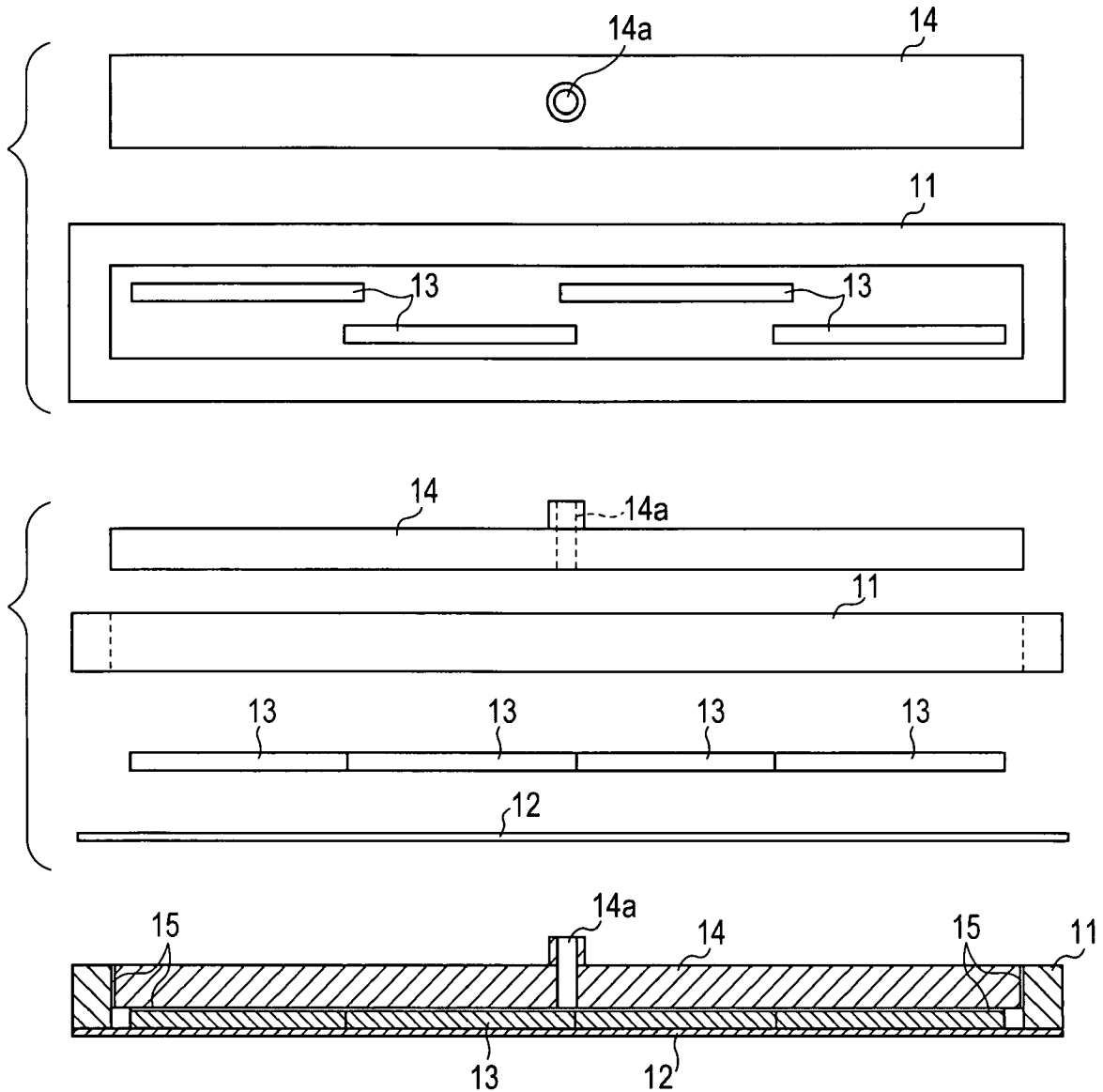

FIGS. 1A to 1C are drawings showing the line head 10 according to the embodiment, wherein FIG. 1A is an exploded plan view before assemble; FIG. 1B is a side view before the assemble; and FIG. 1C is a side sectional view after the assemble.

The line head 10 includes an outer frame 11 (corresponding to a first base according to the present invention), a nozzle plate 12, a head chip 13, and a head support member 14 (corresponding to a second base according to the present invention).

The outer frame 11 shaped in a substantially rectangular frame may be made of ceramics having a linear expansion coefficient within a range of 0.5 to 1.5 times higher than that of silicon monocrystal or polycrystal (powder sintered ceramics sintered from material powder especially according to the embodiment). In this case, the outer frame 11 (ceramics) has a linear expansion coefficient of about 3 to 3.5 ppm similar to (substantially the same as) that of the head chip 13 (semiconductor substrate), which has a silicon linear expansion coefficient of about 2.5 to 3.0 ppm. If the outer frame 11 is made of ceramics in such a manner, the Young's modulus of the outer frame 11 becomes similar to that of a metallic material. Also, the linear expansion coefficient can be adjusted by varying the composition and fabricating method of the ceramics.

The nozzle plate 12 is a very thin film with a thickness of about 10 to 20 μm and has a plurality of nozzle holes. In view of workability, cost, wettability, and the Young's modulus, the nozzle plate 12 uses electro-cast nickel as a metallic material and polyimide as a polymeric material.

The head chip 13 is composed of a silicon semiconductor substrate, heater elements formed on the substrate, and a barrier layer laid on the heater elements (the same structure as that of the head chip 4 in the conventional technique mentioned above). The barrier layer, made of a photosensitive cyclized-rubber resist or an exposure-curing dry-film resist, is formed by removing unnecessary portions by a photolithographic process after the entire surface, on which the heater elements are formed, of the semiconductor substrate is deposited with the layer. With the barrier layer, part of a liquid chamber (ink chamber) and a flow path for supplying ink to the liquid chamber (individual flow path for each liquid chamber) are constructed.

The head support member 14 serves as a flow path plate according to the embodiment, and as shown FIGS. 1A to 1C, it includes a liquid inlet 14*a* cylindrically passing through in the vertical direction.

The head support member 14 is required to withstand not only tension but also compression, bending, and twisting (not plastically deformed) differently from the thin-film nozzle plate 12. Thus, the head support member 14 is generally shaped in a plate or bar.

Then, the head support member 14 may be made of ceramics identically to the outer frame 11. Thereby, the linear expansion coefficient of the head support member 14 is equalized to that of the outer frame 11. However, the workability of the ceramics is not so excellent as to a metallic material or a polymeric material. Then, the head support member 14 is manufactured with the following materials and methods.

First, the head support member 14 may be made of a material with a linear expansion coefficient being 0.5 to 1.5 times higher than that of the outer frame 11. For example, as long as the head support member 14 has substantially the same linear expansion coefficient as that of the outer frame 11, the rigidity of the head support member 14 (expressed by E×I which is the product of the Young's modulus (modulus of longitudinal elasticity) E and the geometrical moment of inertia I for the flexural rigidity) has no limit. Whereas, if the linear expansion coefficient of the head support member 14 is larger than that of the outer frame 11 within the above range, the rigidity of the head support member 14 must be smaller than that of the outer frame 11.

Secondly, the head support member 14 may be made of a polymeric material with substantially the same linear expansion coefficient as that of the ceramics. For example, liquid crystal plastics (also referred to as LCP or a liquid crystal polymer, specifically, VECTRA B230 made from Polyplastics Co., Ltd.) may be preferable. In addition, the linear expansion coefficient of the liquid crystal plastics is about 3.0 ppm. Since the polymeric material has a small linear expansion coefficient so as to have a linear expansion coefficient similar to that of the outer frame 11, the mechanical strength and further wettability are excellent.

Thirdly, the head support member 14 may be made of invar (iron 36% and a nickel alloy), titanium or a titanium alloy, nickel steel, nickel plate steel (wettability improved due to nickel plating), stainless steel, or aluminum nitride.

Moreover, as shown in FIGS. 1A to 1C, the liquid inlet 14*a* is provided in the head support member 14, so that a material and a fabrication method capable of forming the liquid inlet 14*a* are required. In this case, any one of the following methods may be adopted.

Figure 6:
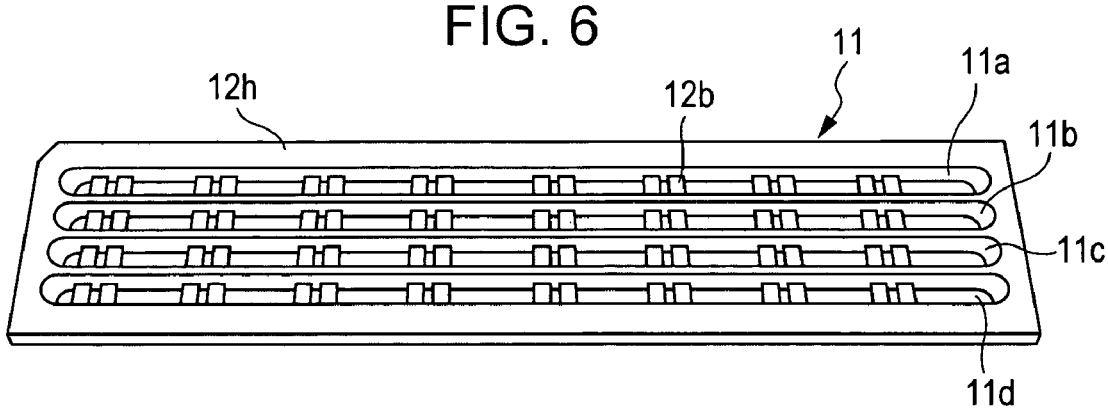
FIG. 6 is a drawing showing the outer frame for a four-color line head.

First, a method may be adopted in that the flat plate of the invar, nickel steel, nickel plate steel, or stainless steel mentioned above is plastically fabricated so as to form the liquid inlet 14*a* while a flow path communicating with the liquid inlet 14*a* is fabricated therein. For example, a space is formed inside the head support member 14 so as to fabricate a path equivalent to the conventional liquid supply path 2*a* shown in FIG. 6 (see a liquid supply path 14*b* shown in FIGS. 2A and 2B, which will be described later). When the flat plate is plastically fabricated, the strength of bending, twisting, and compression can be increased larger than that of the flat plate itself.

Secondly, the liquid inlet 14*a* may be formed by injection-molding a polymeric material with substantially the same linear expansion coefficient as that of the ceramics (the LCP mentioned above, for example). Furthermore, a liquid supply path communicating with the liquid inlet 14*a* may also be formed in a similar manner (the liquid supply path 14*b* shown in FIGS. 2A and 2B).

Figure 2A:
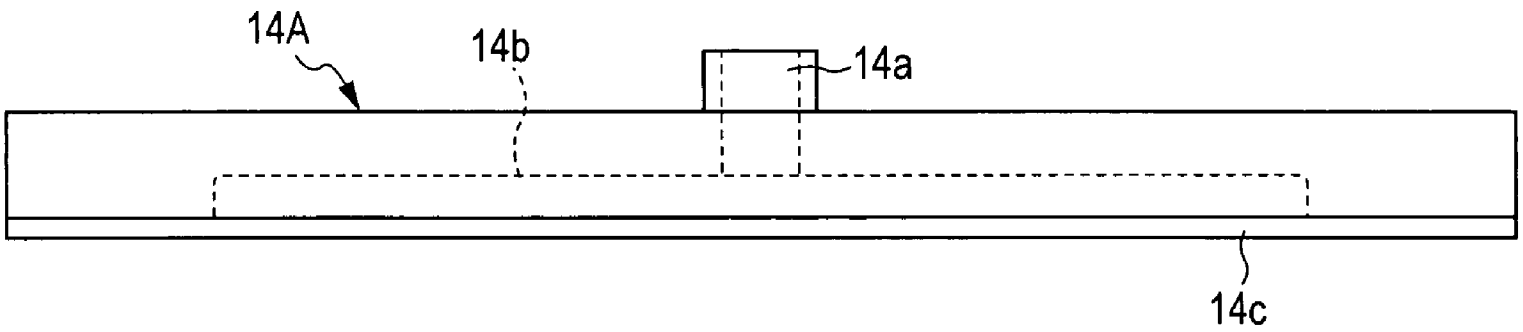
FIGS. 2A and 2B are drawings showing a head support member having a strain absorption plate.
Figure 2B:
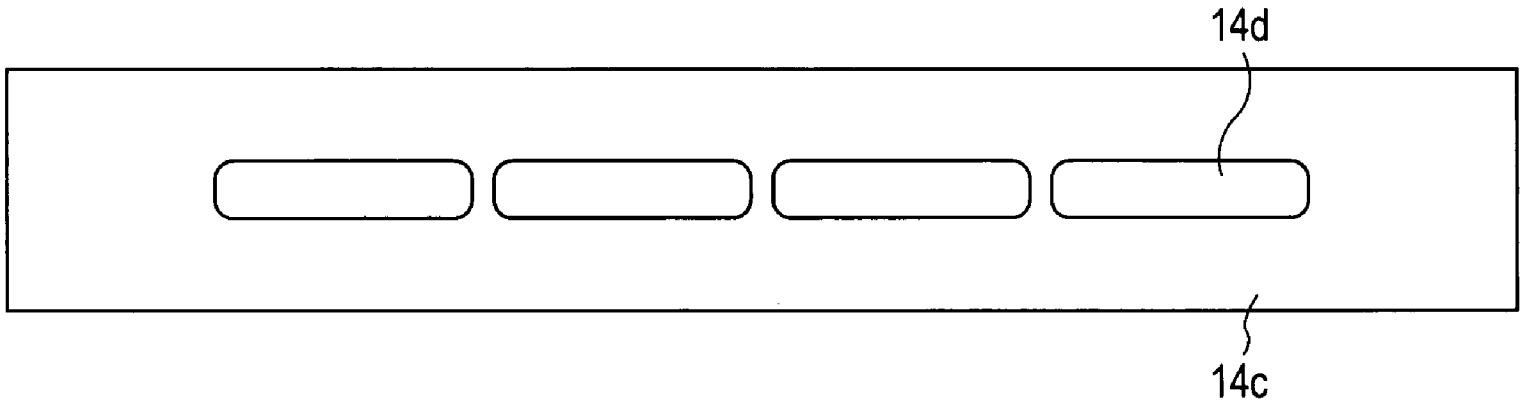

Thirdly, a method may be adopted, in which in the second method, a strain absorption plate is provided under the head support member 14. FIGS. 2A and 2B show a head support member 14A having a strain absorption plate 14*c*. The head support member 14A is provided with the liquid supply path 14*b* communicating with the liquid inlet 14*a* by forming a space inside as well as the liquid inlet 14*a*.

The strain absorption plate 14*c* is a flat plate, and is bonded on the top surface of the head chip 13 when the strain absorption plate 14*c* is placed on the head chip 13. Also, the top surface of the strain absorption plate 14*c* is bonded on the bottom surface of the head support member 14A.

The strain absorption plate 14*c* is provided with a plurality of oval through-holes 14*d*. Through the through-holes 14*d*, the liquid supply path 14*b* is communicated to the head chip 13.

In this case, the strain absorption plate 14*c* may be formed from a flat plate of invar, nickel plate steel, stainless steel, or ceramics while part of the head support member 14A other than the strain absorption plate 14*c* may be formed of a polymeric material like in the second method. By fabricating the head support member 14A from such a composite material of a metallic material and a polymeric material, the linear expansion coefficient and compression are secured with the strain absorption plate 14*c* made of the metallic material while workability and cost are improved by injection-molding the polymeric material.

Next, a manufacturing method of the line head 10 will be described.

First, referring to FIG. 1B, the nozzle plate 12 is bonded on the outer frame 11 (first process). The bottom frame face of the outer frame 11 is bonded on the nozzle plate 12. The bonding is performed at a temperature T1 which is a maximum temperature in processes of the manufacturing the line head 10 (150° C. or more according to the embodiment). In addition, the temperature T1 is higher than the maximum temperature of the line head 10 during driving. A heat-curing sheet adhesive may be used as an adhesive, and specifically an epoxy-resin adhesive may be used.

According to the embodiment, the linear expansion coefficient of the nozzle plate 12 is larger than that of the outer frame 11. When the nozzle plate 12 is made of nickel especially according to the embodiment, the linear expansion coefficient thereof is about 12 to 13 ppm. Whereas, when the outer frame 11 is made of ceramics, the linear expansion coefficient thereof is about 3 to 3.5 ppm.

When the nozzle plate 12 is bonded on the outer frame 11 under the circumstance of temperature 150° C., a force is applied to the nozzle plate 12 in a compressing direction if the temperature is below 150° C. That is, at a temperature below 150° C., a tensile stress is always produced in the nozzle plate 12. Thereby, under circumstances of temperature 150° C. or less, the nozzle plate 12 is maintained to have a tightly stretched state.

Then, the head chip 13 is bonded on the nozzle plate 12 (second process). The bonding between the head chip 13 and the nozzle plate 12 is performed under a circumstance of temperature T2 lower than the temperature T1. The temperature T2 according to the embodiment is 120° C. In order to bond the head chip 13 on the nozzle plate 12, the barrier layer of the head chip 13 needs to be bonded on the nozzle plate 12; the bonding temperature is caused by characteristics of the barrier layer, so that the barrier layer according to the embodiment is cured under the circumstance of temperature 120° C.

The nozzle plate 12 herein is provided with nozzle holes, and is bonded so that the nozzle holes correspond to the heater elements of the head chip 13 (so that the axis of each nozzle hole agrees to that of each heater element of the head chip 13 in the vertical direction). The nozzle holes are thereby arranged on the heater elements while around the heater element, a liquid chamber is formed with the barrier layer on the side and the nozzle plate 12 on the top.

Under the circumstance of temperature 120° C., a tensile stress is produced in the nozzle plate 12. That is, the nozzle plate 12 and the outer frame 11 are bonded together without strain under the circumstance of temperature 150° C., so that at the temperature 120° C., the nozzle plate 12 contracts more than the outer frame 11 due to the linear expansion coefficient difference between the nozzle plate 12 and the outer frame 11. However, since the contraction force of the nozzle plate 12 is smaller than the rigidity of the outer frame 11, even when the temperature is lowered from 150° C., the strain is scarcely produced in the outer frame 11 so that the contraction of the nozzle plate 12 agrees to that of the outer frame 11.

Figure 8A:
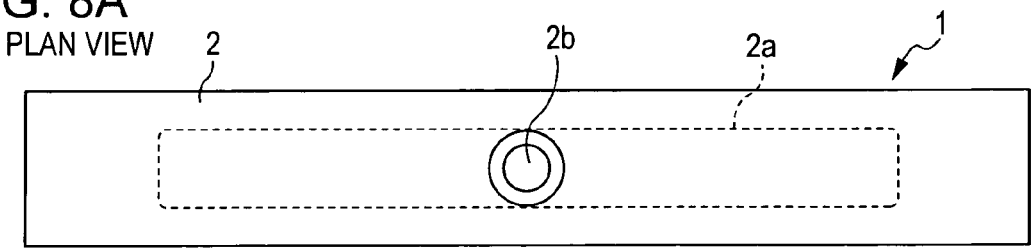
FIGS. 8A to 8D are drawings schematically showing such kind of line head.
Figure 8B:
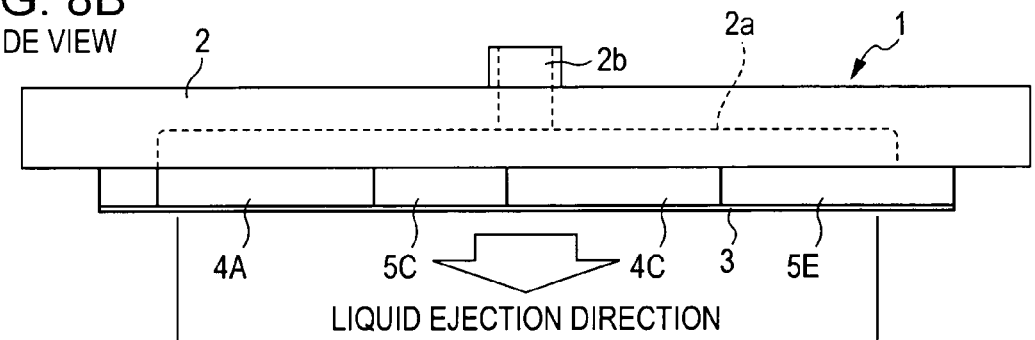
Figure 8C:
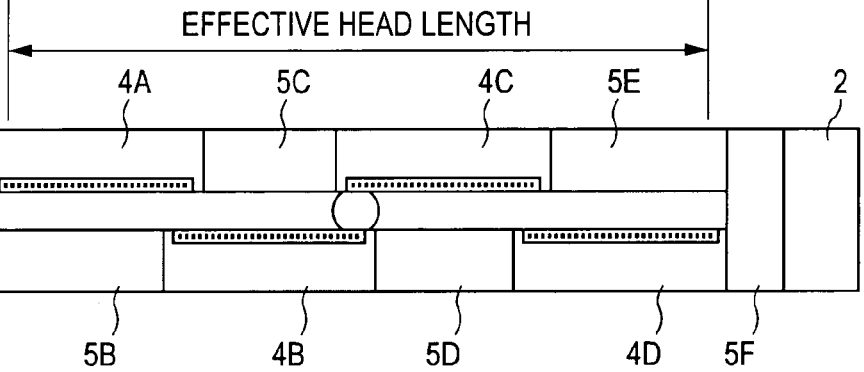
Figure 8D:
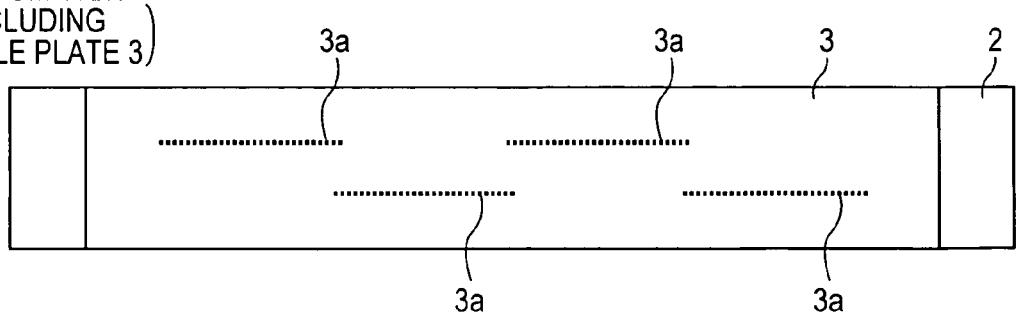
Figure 9:
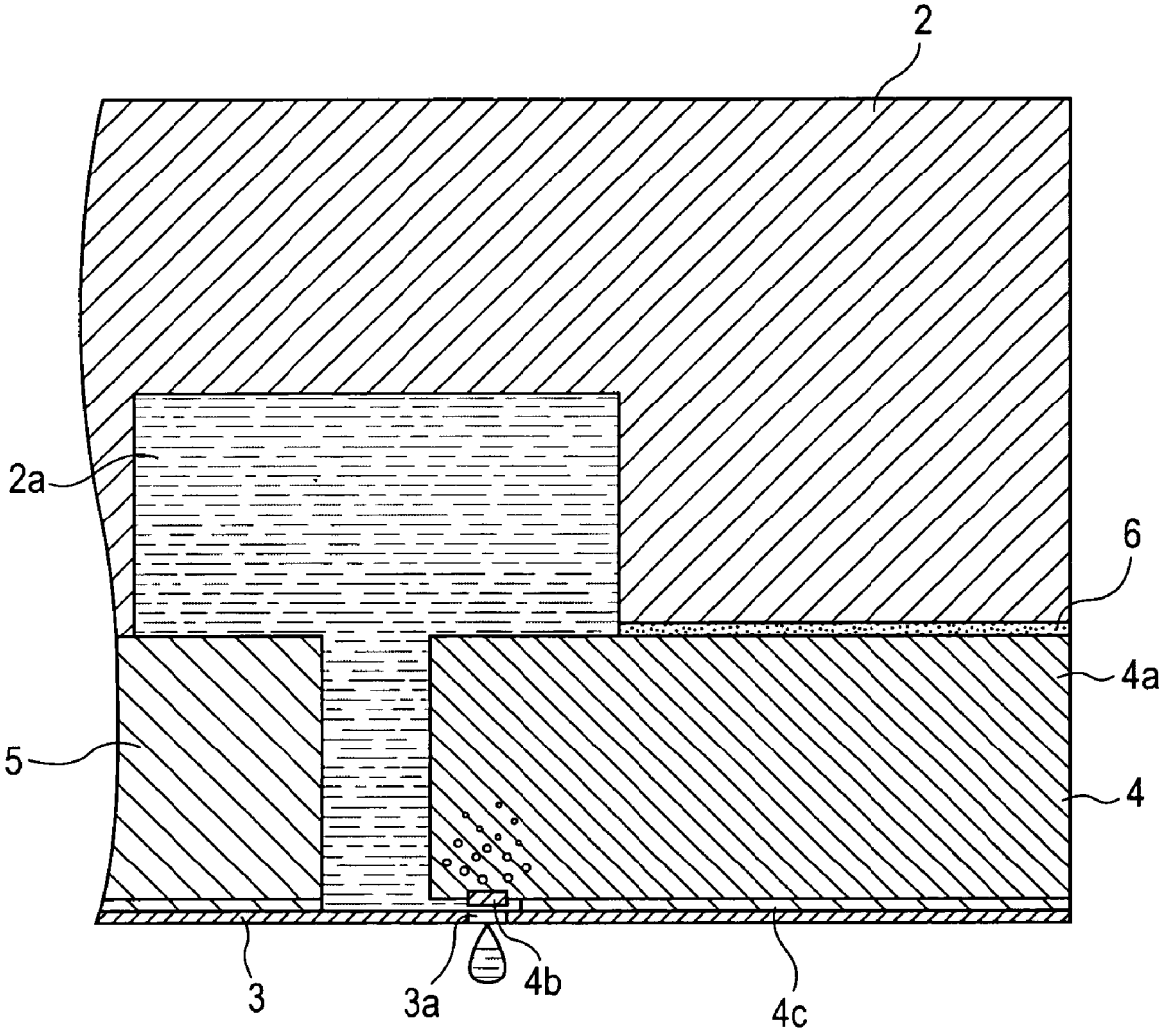
FIG. 9 is a sectional view showing a flow path plate, the head chip, and the nozzle plate in detail.
Figure 10A:
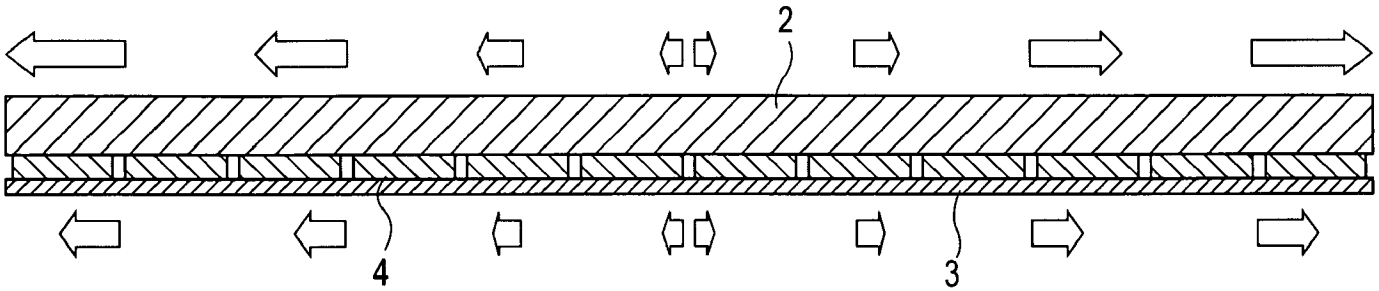
FIGS. 10A to 10C are sectional views illustrating generation of thermal stress and strain in the line head.
Figure 10B:
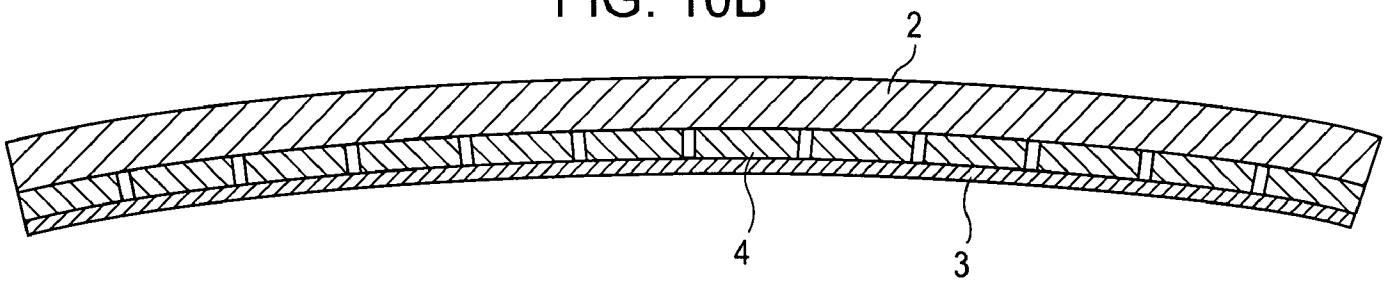
Figure 10C:
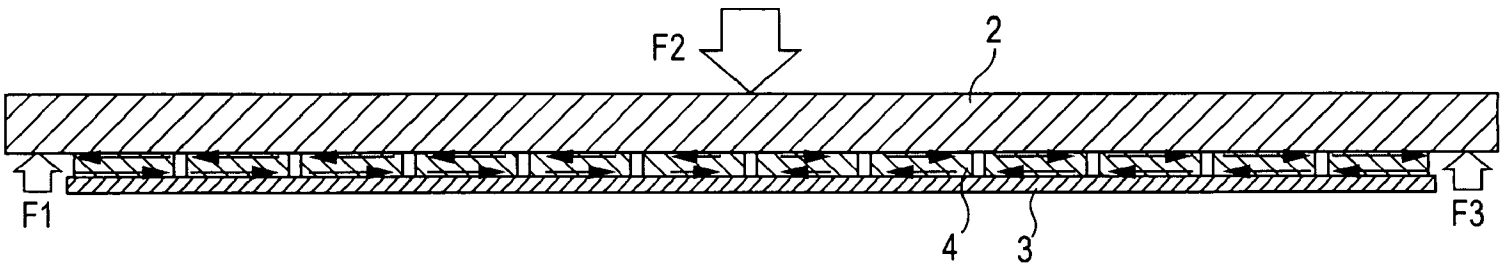
Figure 11B:
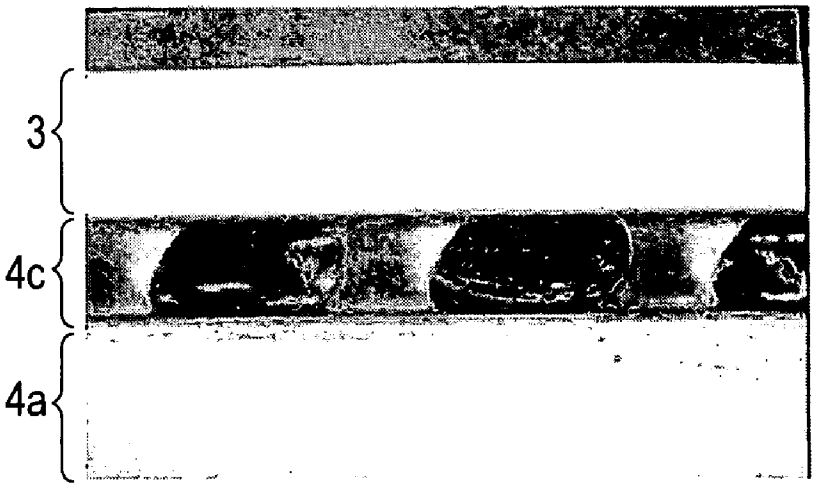
FIGS. 11A and 11B show pictured results of a liquid ejection part of the line head when thermal stress is applied thereto.
Figure 11A:
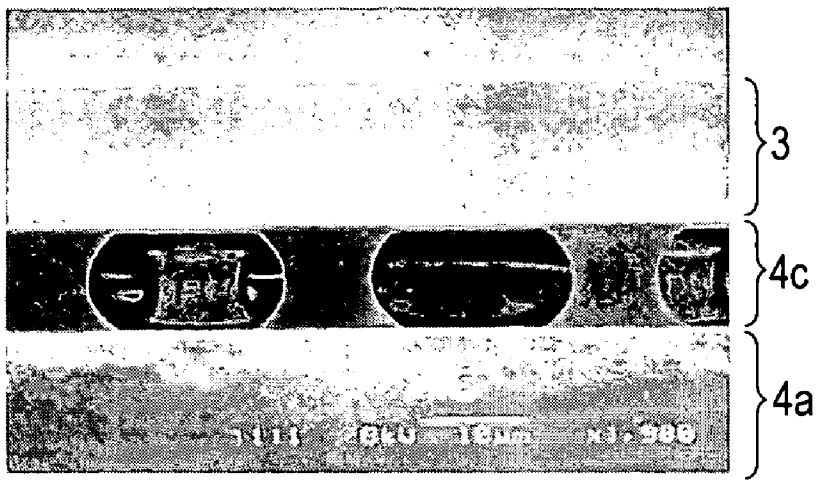

Although not shown in FIGS. 1A to 1C, dummy chips are arranged between the head chips 13 in the longitudinal direction so as to interpose therebetween substantially without spaces like the arrangement shown in FIG. 8C. The dummy chip may have the heater element, the barrier layer, and the individual flow path formed therein in the same way as in the head chip 13. Alternatively, the dummy chip may only have the barrier layer laid on the substantially entire region of the semiconductor substrate without the heater element and the individual flow path. At any rate, the dummy chip does not eject liquid droplets.

Then, under the circumstance of temperature T3 lower than the temperature T2, the head support member 14 is bonded on the outer frame 11 and the head chips 13 (third process).

Figure 3:
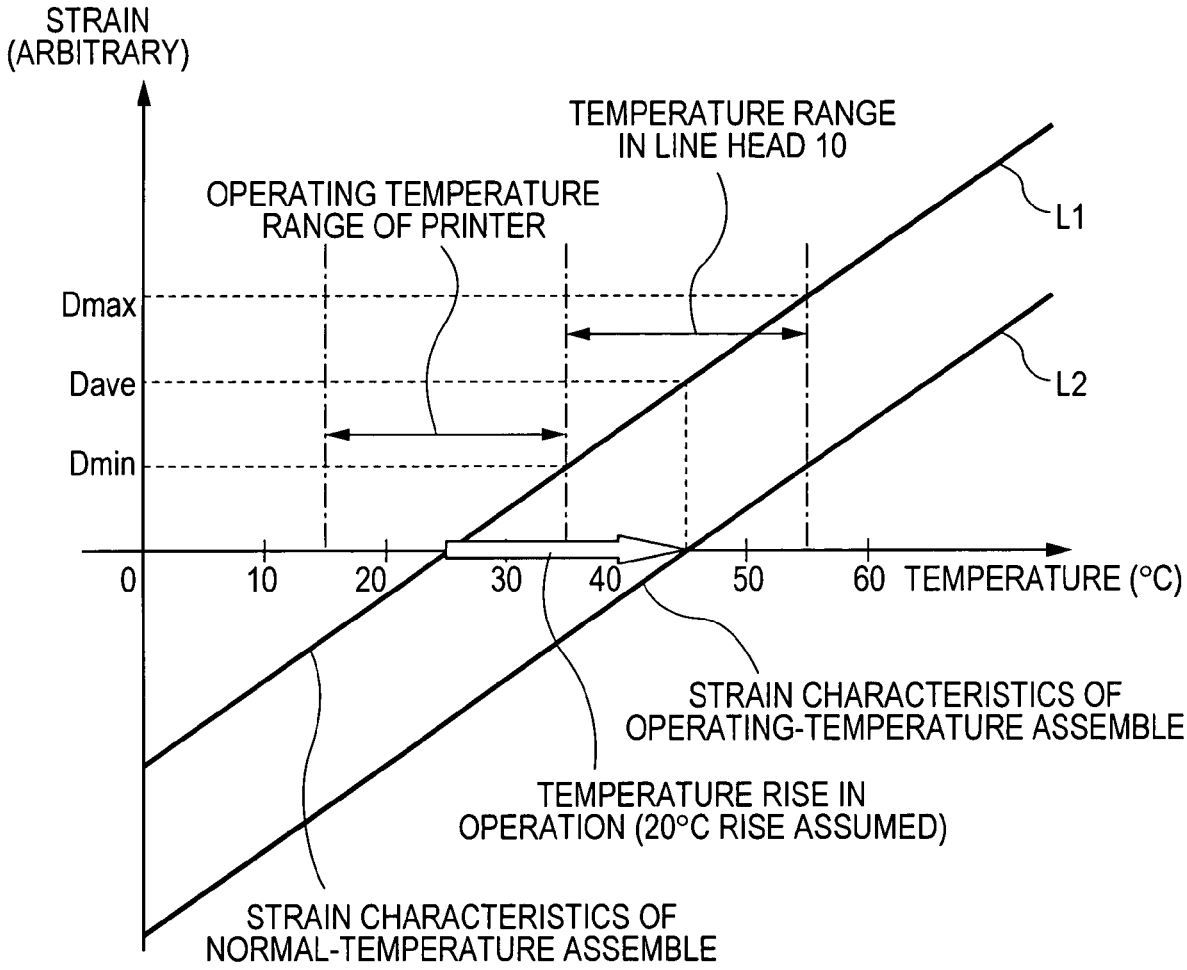
FIG. 3 is a graph plotted with temperature changes as abscissa against amounts of stain as ordinate.

The relationship between ambient temperatures during assemble and the strain will be described. FIG. 3 is a graph plotted with temperature changes as abscissa against amounts of stain as ordinate. For brevity, the temperature is assumed proportional to the strain within the range of the graph of FIG. 3.

Referring to FIG. 3, a straight line L1 shows strain characteristics during assemble at the normal temperature (25° C. according to the embodiment); when the operating proof temperature of a printer is 15 to 35° C., assembling at its median temperature 25° C. exhibits characteristics of the straight line L1. That is, the strain is zero at 25° C.; and when the temperature becomes 35° C. for example, the strain is D min.

By taking only the range of the operating proof temperature into consideration, the strain during assembling can be minimized at the median temperature 25° C. (normal temperature) of the range.

However, when the printer is used in practice, the temperature of the line head 10 increases higher than the room temperature, becoming about 45° C. at the room temperature of 25° C.

Accordingly, during the assemble at 25° C. according to the straight line L1, the amount of the strain becomes Dave when the temperature of the operating line head 10 arrives at 45° C. Whereas, when the assemble temperature becomes 45° C., which is an average operating temperature (estimate) of the line head 10, the characteristics exhibit a straight line L2, so that the strain is zero at 45° C.

Then, according to the embodiment, the bonding temperature of the head support member 14 is established at 45° C. (within the range of 45±10° C. as a design value) so as to suppress the strain in the head support member 14 at an average operating temperature (45° C.). That is, the temperature T3 is 45±10° C.

When the printer is started after a long period of rest, the temperature of the line head 10 is reduced lower than the room temperature (25° C.), so that a strain may be produced in the head support member 14 at this time. In such a case, the line head 10 may be preliminarily heated when necessary.

Also, under the circumstance of temperature 45° C., as shown in FIGS. 1A to 1C, the length between both external ends of the head support member 14 in the longitudinal direction is established to be substantially identical (the length of the head support member 14 being slightly shorter) to the length between both internal ends of the outer frame 11 in the longitudinal direction. Thereby, at the temperature T3, the head support member 14 is fitted inside the outer frame 11 substantially without a clearance. Thus, under the circumstance of temperature 45° C., no thermal stress is produced in the head support member 14 and the outer frame 11.

Then, as shown in FIGS. 1A to 1C, the external side face of the head support member 14 in the longitudinal direction is bonded on the internal side face of the outer frame 11 in the longitudinal direction with an adhesive (an adhesion layer 15 being produced between both the side faces). Also, the bottom surface of the head support member 14 is bonded on top surfaces of the head chips 13 (and the dummy chips which are not show in FIGS. 1A to 1C) with an adhesive so as to form the adhesion layer 15 therebetween in the same way.

Figure 4:
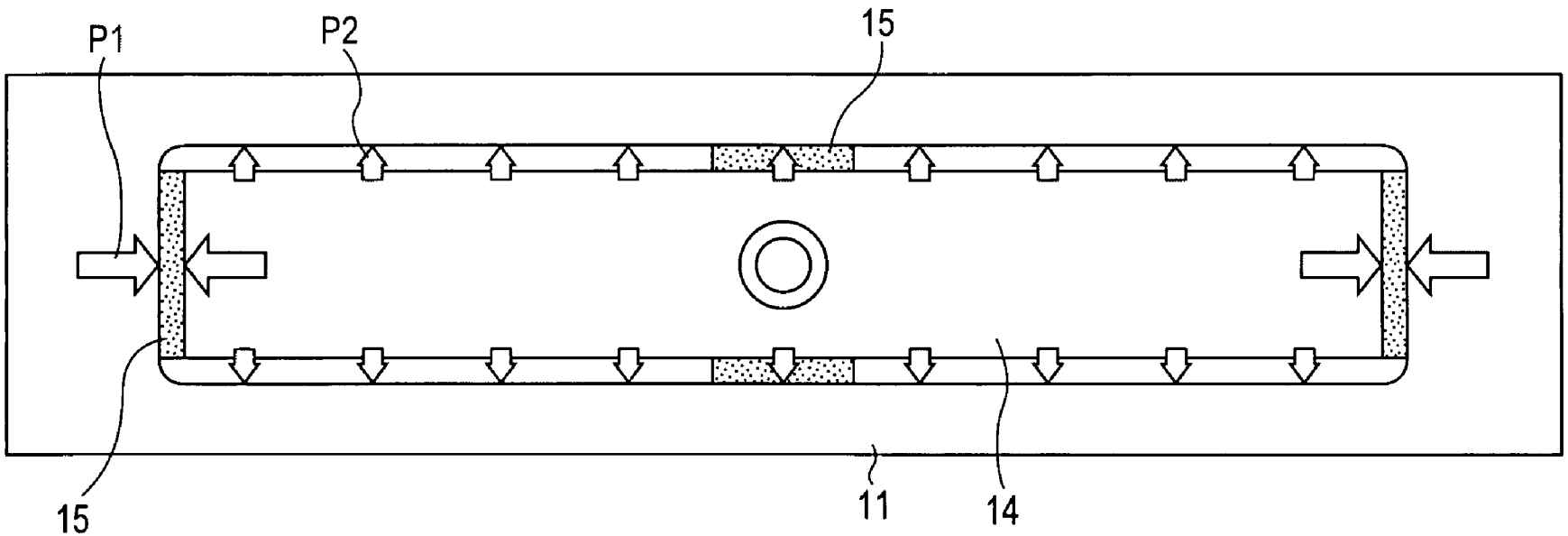
FIG. 4 is a plan view showing the positional relationship between the head support member, an outer frame, and an adhesion layer.

FIG. 4 is a plan view showing the positional relationship between the head support member 14, the outer frame 11, and the adhesion layer 15. In addition, the clearance between the head support member 14 and the outer frame 11 is exaggeratedly shown in FIG. 4, so that the clearance is not so large as in the drawing in practice. As shown in FIG. 4, the adhesion layers 15 are provided not only on both ends of the head support member 14 and the outer frame 11 in the longitudinal direction but also in the substantial mid portions.

In the line head 10 structured as described above, the temperature in a stand-by period or during operating is 150° C. or less so that a tensile stress is always produced in the nozzle plate 12. At 150° C. or less, the nozzle plate 12 expands/contracts following expansion/contraction of the outer frame 11. Moreover, the head chips 13 are bonded on the nozzle plate 12: since the linear expansion coefficient of the head chip 13 is substantially the same as that of the outer frame 11 so that the nozzle plate 12 follows the expansion/contraction of the outer frame 11, even when temperature change occurs, the positional relationship between the heater elements of the head chip 13 and the nozzle holes of the nozzle plate 12 can be maintained.

Furthermore, at the average operating temperature (45° C.) of the line head 10, no thermal stress is produced in the head support member 14 and the outer frame 11 so as to have no strain. When the linear expansion coefficient of the head support member 14 is larger than that of the outer frame 11, a compression stress (arrows P1 in FIG. 4) is produced at a temperature higher than 45° C.

In this case, the elongation of the head support member 14 exceeds that of the outer frame 11; however, the head support member 14 is clamped at its both ends in the longitudinal direction by the outer frame 11 while the junction surface rigidity of the outer frame 11 is established to be larger than that of the head support member 14. That is, when the temperature rises higher than 45° C., a compression stress is produced in the head support member 14 while the strain of the head support member 14 is restricted by the outer frame 11.

As shown in FIG. 4, since the head support member 14 is provided with the adhesion layers 15 not only at both ends in the longitudinal direction but also in the substantial mid portions in the longitudinal direction, the phenomenon in the conventional technique (the head support member 14 being warped like an arrow) cannot occur. Since both ends of the head support member 14 in the longitudinal direction is suppressed by the outer frame 11, when the temperature rises, a strain is also generated in a direction perpendicular to the longitudinal direction (arrows P2 in FIG. 4). Hence, an allowance is necessary for the clearance between the head support member 14 and the outer frame 11 especially in the direction perpendicular to the longitudinal direction, and it is preferable that the adhesion layer 15 have flexibility (rubber elasticity).

For example, a polyurethane resin adhesive can include the flexibility (rubber elasticity) corresponding to the combination of materials. Also, an elastomer resin adhesive is made from a material having rubber elasticity after curing as a base, so that the cured adhesive has more or less rubber elasticity. For example in a silicone resin, owing to polysiloxane as its principal material, the cured resin exhibits the rubber elasticity in any one of room curing and hot setting types.

As described above, when the line head 10 is made from the combination of a plurality of materials with different linear expansion coefficients, the strain due to the temperature change can be suppressed to the minimum.

Then, the line head 10 is mounted on an inkjet printer body and is moved relative to a recording medium. For example, in a state that the line head 10 is fixed to the printer body, the recording medium is moved in a direction perpendicular to the longitudinal direction of the line head 10.

During the relative movement, liquid droplets are ejected from each head chip 13 of the line head 10. That is, the heater element arranged on the head chip 13 is heated such that a soaring force is applied to liquid on the heater element by the pressure change due to generation/dissipation of bubbles. By this soaring force, the liquid droplets are ejected from the nozzle hole so as to form images by the landing of the liquid droplets on a recording medium.

By such driving of the line head 10, the temperature of the line head 10 rises; however, the distance between the head chip 13 and a recording medium scarcely changes even when the temperature change is produced in the line head 10 (even if the thermal stress is generated inside the line head 10), resulting in high-quality printing.

EXAMPLE

Continuously, an example of the present invention will be described. In the example, the line head 10 was four-color line head (Y: yellow, M: magenta, C: cyan, and K: black).

First, the outer frame 11 was made of ceramics (powder sintered ceramics). As this was the outer frame 11 for the four-color line head, four grooves (ovals 11*a*, 11*b*, 11*c*, and 11*d*) were provided formed in parallel with each other (see FIG. 6, which is the outer frame 11 viewed from the top). The major diameter, minor diameter, and thickness of each groove were 227 mm, 6.0 mm, and 5.0 mm, respectively.

On both surfaces of the outer frame 11, electro-cast nickel thin films (thickness 13 μm) were laid under the circumstance of temperature 160° C. (in the example, the temperature was 160° C. more than 150° C.). The nozzle plate 12 was provided on the bottom surface, and on the top surface, a reinforcing plate 12*h* was provided for improving the tension balance. Applying tension on both surfaces reduces the difference between stresses applied on both the surfaces.

Figure 5:
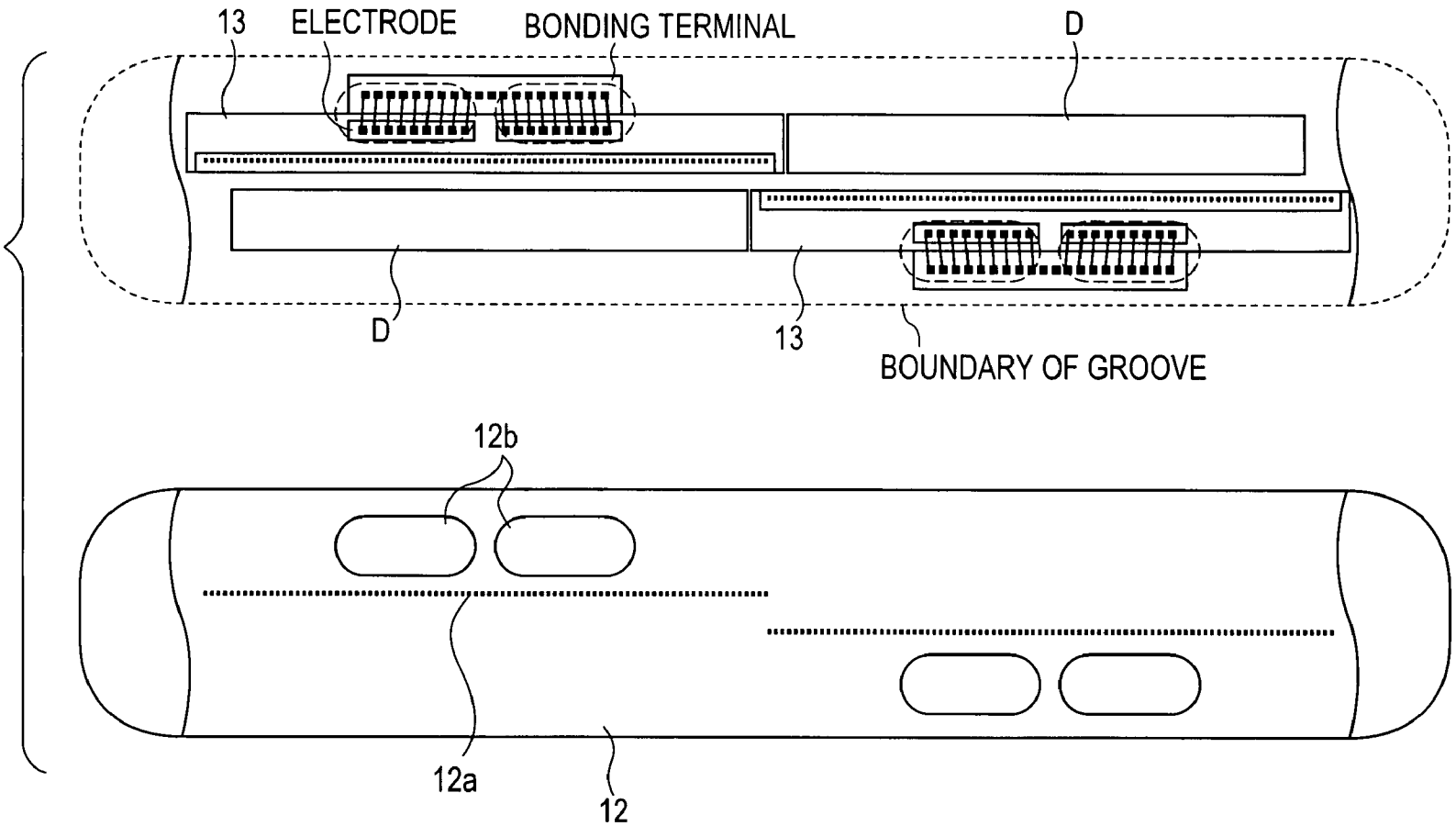
FIG. 5 is a drawing of an oval for one color of the outer frame showing the positional relationship between a head chip and a nozzle plate viewed from the bottom.

FIG. 5 is a drawing of the oval for one color of the outer frame 11 showing the positional relationship between the head chip 13 and the nozzle plate 12 viewed from the bottom.

In the example, the number of bondings of each head chip 13 was large, and if long bonding work holes 12*b* were provided simultaneously, the strain of the nozzle plate 12 bonded at 160° C. was increased. A bonding terminal with a number of pads was provided, and as for the head chip 13, an electrode was divided into two divisions, so that the strain on the nozzle plate 12 was reduced by corresponding half of the oval to each division.

Between the head chips 13, the dummy chips D mentioned above were arranged, and bonded by the same method as that of the head chip 13. However, electrical connection was not provided to the dummy chips D.

The clearance between the head chip 13 and the dummy chip D was sealed up after being bonded on the nozzle plate 12 so as to prevent liquid from leaking out of a region surrounded by the head chip 13 and the dummy chip D.

Also, three kinds of the head support member 14 were manufactured. The first member was made of aluminum as a ground material covered with a polyimide resin on the surface. The second member was made of injection-molded liquid crystal plastics. The third member used a flat plate of stainless steel (thickness 0.3 mm). At both ends of the head support member 14, grooves were provided for making spaces (10 mm×0.9 mm) for inserting the bonding terminal thereinto.

The assemble process is as follows:

(1) Under the circumstance of temperature 160° C., the nozzle plate 12 and the reinforcing plate 12*h* were boned on the outer frame 11.

(2) The head chip 13 was bonded so as to align it with the nozzle holes 12*a* formed on the nozzle plate 12 with high accuracy by photochemical engraving in advance.

(3) The dummy chips D were bonded with reference to positions of the head chips 13.

(4) The clearance between the dummy chip D and the head chip 13 was sealed up.

(5) The head support member 14 was bonded to the head chip 13 by applying an adhesive on top surfaces of the head chip 13 and the dummy chip D, and dropping the head support member 14 through the groove formed on the outer frame 11 from the top.

(6) A predetermined position around the head support member 14 was filled with an adhesive, and the head support member 14 was pressurized with a fixing jig, and left to stand for a predetermined period (for curing the adhesive). This process was also tried at a normal temperature (25° C.) in addition to under the circumstance of temperature 45° C., which is the average operating temperature of the line head 10.

Figure 7:
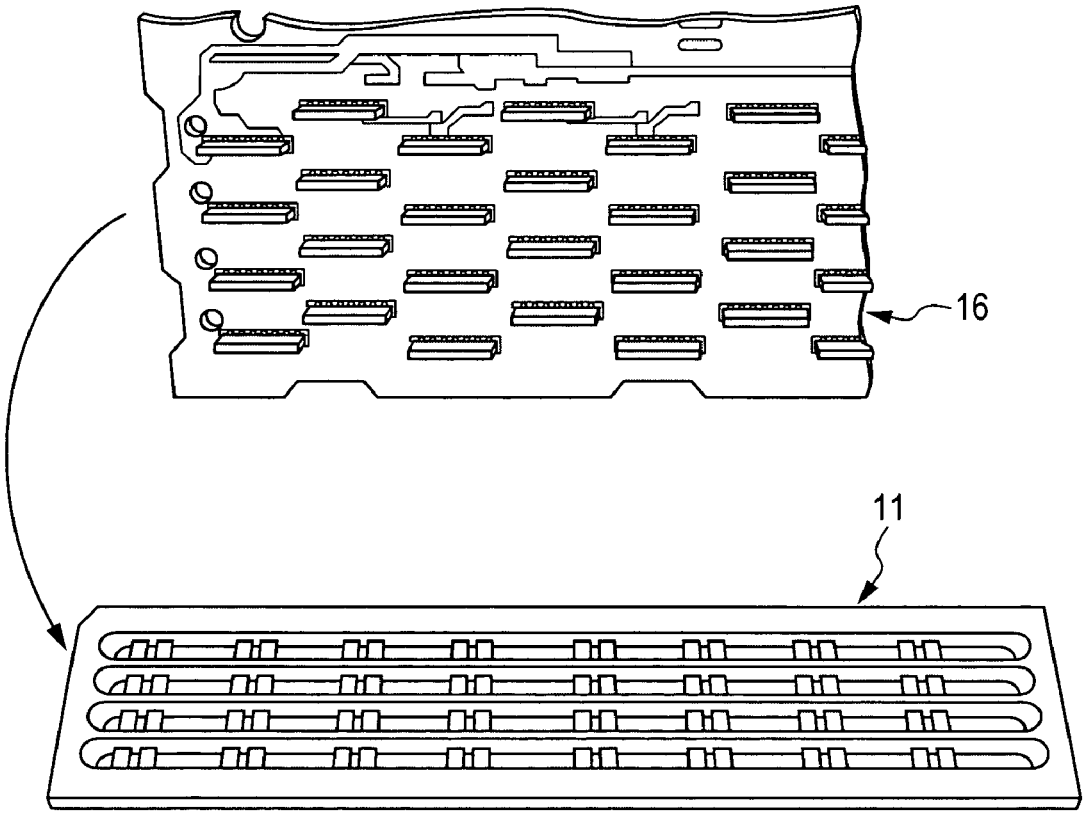
FIG. 7 is an explanatory view of a bonding process of a terminal plate onto the outer frame.

(7) After confirming the bonding of the head support member 14, the fixing jig was removed; and a terminal plate 16 (see FIG. 7, in which the terminal plate 16 is enlarged for understanding), having the required number of bonding terminals (in the example, 16 for each color and 64 in total) arranged on a printed board with high accuracy, was inserted into the outer frame 11 from the above the head support member 14 for fixing it with an adhesive.

(8) Wire bonding was carried out through the bonding work holes 12*b* shown in FIG. 5 and provided on the nozzle plate 12.

(9) The bonding work holes 12*b* were sealed up.

Using the line head 10 manufactured by the process mentioned above, images were printed. In addition, the head support member 14 was made of aluminum and polyimide, and the printing was performed at the room temperature 35° C. using both the head support members 14 bonded at the normal temperature 25° C. and bonded at the average operating temperature 45° C. As a result, in any of the samples, it was confirmed that the print quality was improved more than ever and the effect due to the thermal stress was reduced.

What is claimed is:

1. A liquid ejection head comprising:

a nozzle plate having nozzle holes formed thereon for ejecting liquid droplets;

a frame-shaped first support base;

a head chip having a plurality of heater elements arranged on a semiconductor substrate; and a second support base, at least part of which being arranged within a region inside the frame of the first support base, the liquid ejection head having a plurality of the head chips joined onto the nozzle plate in a line so that the heater elements oppose the nozzle holes, respectively, wherein the linear expansion coefficient of the head chip is substantially the same as that of the first support base; the linear expansion coefficient of the nozzle plate is larger than that of the first support base; and the linear expansion coefficient of the second support base is larger than that of the first support base, wherein the nozzle plate is joined onto the first support base while under the circumstance of temperature at which a thermal stress is not generated on the junction surface between the first support base and the second support base, a tensile stress is produced in the nozzle plate by the first support base, wherein the second support base is joined onto the first support base so that at least parts of external side faces at both ends of the second support base in a longitudinal direction are fitted between at least parts of internal side faces of the first support base, and wherein when the second support base thermally expands relative to the first support base, a compression stress is produced in the second support base while a strain of the second support base is restricted by the first support base.

2. The head according to claim 1, wherein at an average operating temperature of the liquid ejection head, no compression stress is produced on the junction surface between the second support base and the first support base while a tensile stress is generated on the nozzle plate by the first support base.

3. The head according to claim 1, wherein in a range of 45±10° C., which is an average operating temperature of the liquid ejection head, no compression stress is produced on the junction surface between the second support base and the first support base while a tensile stress is generated on the nozzle plate by the first support base.

4. The head according to claim 1, wherein the linear expansion coefficient of the second support base is larger than that of the first support base, and is also lower than 1.5 times that of the first support base.

5. The head according to claim 1, wherein the first support base is made of ceramics having a linear expansion coefficient within a range of 0.5 to 1.5 times that of silicon monocrystal or silicon polycrystal.

6. The head according to claim 1, wherein the nozzle plate is made of one of nickel and polyimide.

7. The head according to claim 1, wherein the second support base is made of a combination of one or more materials selected from ceramics having a linear expansion coefficient within the range of 0.5 to 1.5 times that of silicon monocrystal or silicon polycrystal, a polymeric material having a linear expansion coefficient within the range of 0.5 to 1.5 times that of silicon monocrystal or silicon polycrystal, invar, titanium or a titanium alloy, nickel steel, nickel plate steel, stainless steel, and aluminum nitride.

8. The head according to claim 1, wherein the second support base comprises a liquid inlet formed by opening part of the second support base and a supply path communicating with the liquid inlet and onto the heater elements of the head chip.

9. The head according to claim 1, wherein the second support base comprises a liquid inlet formed by opening part of the second support base and a supply path communicating with the liquid inlet and onto the heater elements of the head chip, and the second support base is made of a combination of one or more materials selected from ceramics having a linear expansion coefficient within the range of 0.5 to 1.5 times that of silicon monocrystal or silicon polycrystal, a polymeric material having a linear expansion coefficient within the range of 0.5 to 1.5 times that of silicon monocrystal or silicon polycrystal, invar, titanium or a titanium alloy, nickel steel, nickel plate steel, stainless steel, and aluminum nitride.

10. The head according to claim 1, wherein the second support base comprises a liquid inlet formed by opening part of the second support base and a supply path communicating with the liquid inlet and onto the heater elements of the head chip, wherein part of the second support base including the liquid inlet is made of one of ceramics having a linear expansion coefficient within the range of 0.5 to 1.5 times that of silicon monocrystal or silicon polycrystal, invar, nickel steel, nickel plate steel, and stainless steel, and wherein the supply path is made of a polymeric material having a linear expansion coefficient within the range of 0.5 to 1.5 times that of silicon monocrystal or silicon polycrystal.

11. A liquid ejection head comprising:

a nozzle plate having nozzle holes formed thereon for ejecting liquid droplets;

a frame-shaped first support base;

a head chip having a plurality of heater elements arranged on a semiconductor substrate; and a second support base, at least part of which being arranged within a region inside the frame of the first support base, the liquid ejection head having a plurality of the head chips joined onto the nozzle plate in a line so that the heater elements oppose the nozzle holes, respectively, wherein the linear expansion coefficient of the head chip is substantially the same as that of the first support base; the linear expansion coefficient of the nozzle plate is larger than that of the first support base; and the linear expansion coefficient of the second support base is substantially the same as that of the first support base, wherein the nozzle plate is joined onto the first support base while a tensile stress is produced in the nozzle plate by the first support base, and wherein the second support base is joined onto the first support base so that at least parts of external side faces at both ends of the second support base in a longitudinal direction are fitted between at least parts of internal side faces of the first support base.

12. The head according to claim 11, wherein the first support base is made of ceramics having a linear expansion coefficient within the range of 0.5 to 1.5 times that of silicon monocrystal or silicon polycrystal.

13. The head according to claim 11, wherein the nozzle plate is made of one of nickel and polyimide.

14. The head according to claim 11, wherein the second support base is made of a combination of one or more materials selected from ceramics having a linear expansion coefficient within the range of 0.5 to 1.5 times that of silicon monocrystal or silicon polycrystal, a polymeric material having a linear expansion coefficient within the range of 0.5 to 1.5 times that of silicon monocrystal or silicon polycrystal, invar, titanium or a titanium alloy, nickel steel, nickel plate steel, stainless steel, and aluminum nitride.

15. The head according to claim 11, wherein the second support base comprises a liquid inlet formed by opening part of the second support base and a supply path communicating with the liquid inlet and onto the heater elements of the head chip.

16. The head according to claim 11, wherein the second support base comprises a liquid inlet formed by opening part of the second support base and a supply path communicating with the liquid inlet and onto the heater elements of the head chip, and the second support base is made of a combination of one or more materials selected from ceramics having a linear expansion coefficient within the range of 0.5 to 1.5 times that of silicon monocrystal or silicon polycrystal, a polymeric material having a linear expansion coefficient within the range of 0.5 to 1.5 times that of silicon monocrystal or silicon polycrystal, invar, titanium or a titanium alloy, nickel steel, nickel plate steel, stainless steel, and aluminum nitride.

17. The head according to claim 11, wherein the second support base comprises a liquid inlet formed by opening part of the second support base and a supply path communicating with the liquid inlet and onto the heater elements of the head chip, wherein part of the second support base including the liquid inlet is made of one of ceramics having a linear expansion coefficient within the range of 0.5 to 1.5 times that of silicon monocrystal or silicon polycrystal, invar, nickel steel, nickel plate steel, and stainless steel, and wherein the supply path is made of a polymeric material having a linear expansion coefficient within the range of 0.5 to 1.5 times that of silicon monocrystal or silicon polycrystal.

18. A liquid ejection apparatus comprising:

a nozzle plate having nozzle holes formed thereon for ejecting liquid droplets;

a frame-shaped first support base;

a head chip having a plurality of heater elements arranged on a semiconductor substrate; and a second support base, at least part of which being arranged within a region inside the frame of the first support base; and a liquid ejection head having a plurality of the head chips joined onto the nozzle plate in a line so that the heater elements oppose the nozzle holes, respectively, wherein the linear expansion coefficient of the head chip is substantially the same as that of the first support base; the linear expansion coefficient of the nozzle plate is larger than that of the first support base; and the linear expansion coefficient of the second support base is larger than that of the first support base, wherein the nozzle plate is joined onto the first support base while under the circumstance of temperature at which a thermal stress is not generated on the junction surface between the first support base and the second support base, a tensile stress is produced in the nozzle plate by the first support base, wherein the second support base is joined onto the first support base so that at least parts of external side faces at both ends of the second support base in a longitudinal direction are fitted between at least parts of internal side faces of the first support base, and wherein when the second support base thermally expands relative to the first support base, a compression stress is produced in the second support base while a strain of the second support base is restricted by the first support base.

19. A liquid ejection apparatus comprising:

a nozzle plate having nozzle holes formed thereon for ejecting liquid droplets;

a frame-shaped first support base;

a head chip having a plurality of heater elements arranged on a semiconductor substrate; and a second support base, at least part of which being arranged within a region inside the frame of the first support base; and a liquid ejection head having a plurality of the head chips joined onto the nozzle plate in a line so that the heater elements oppose the nozzle holes, respectively, wherein the linear expansion coefficient of the head chip is substantially the same as that of the first support base; the linear expansion coefficient of the nozzle plate is larger than that of the first support base; and the linear expansion coefficient of the second support base is substantially the same as that of the first support base, wherein the nozzle plate is joined onto the first support base while a tensile stress is produced in the nozzle plate by the first support base, and wherein the second support base is joined onto the first support base so that at least parts of external side faces at both ends of the second support base in a longitudinal direction are fitted between at least parts of internal side faces of the first support base.

20. A manufacturing method of a liquid ejection head, the liquid ejection head comprises:

a nozzle plate having nozzle holes formed thereon for ejecting liquid droplets;

a frame-shaped first support base;

a head chip having a plurality of heater elements arranged on a semiconductor substrate; and a second support base, at least part of which being arranged within a region inside the frame of the first support base, wherein the linear expansion coefficient of the head chip is substantially the same as that of the first support base; the linear expansion coefficient of the nozzle plate is larger than that of the first support base; and the linear expansion coefficient of the second support base is larger than that of the first support base, the manufacturing method comprising the steps of:

joining the nozzle plate onto the first support base under the circumstance of temperature T1;

joining a plurality of the head chips onto the nozzle plate so that the heater elements oppose the nozzle holes, respectively, under the circumstance of temperature T2, which is lower than the temperature T1; and joining the second support base onto the first support base so that at least parts of external side faces at both ends of the second support base in a longitudinal direction are fitted between at least parts of internal side faces of the first support base under the circumstance of temperature T3, which is lower than the temperature T2.

21. The method according to claim 20, wherein in the step of joining the second support base, under the circumstance of the temperature T3, the second support base is bonded onto the first support base with an adhesive and then the adhesive is finished curing.

22. The method according to claim 20, wherein in the step of joining the second support base, the temperature T3 is an average operating temperature of the liquid ejection head.

23. The method according to claim 20, wherein in the step of joining the second support base, the temperature T3 is an average operating temperature of the liquid ejection head which is within the range of 45±10° C.

* * * * *